United States Patent [19]

Gotoh

[11] 4,041,985

[45] Aug. 16, 1977

[54] WEFT SENSOR SYSTEM OF SENSING MALFUNCTION OF A WEAVING LOOM

[75] Inventor: Miyuki Gotoh, Tokorozawa, Japan

[73] Assignee: Nissan Motor Company, Limited, Japan

[21] Appl. No.: 575,135

[22] Filed: May 7, 1975

[51] Int. Cl.[2] ..... D03D 51/34

[52] U.S. Cl. ..... 139/370.2

[58] Field of Search ..... 139/370 A, 370 R, 371, 139/370.1, 370.2; 66/163; 57/81; 28/51; 340/259

[56] References Cited

U.S. PATENT DOCUMENTS

| | | | |
|---|---|---|---|
| 3,410,316 | 11/1968 | Ginttari | 139/370 A |
| 3,482,608 | 12/1969 | Riha et al. | 139/370 A |
| 3,495,633 | 2/1970 | Saramuto et al. | 139/370 A |
| 3,608,590 | 9/1971 | Hohener | 139/370.2 |
| 3,863,241 | 1/1975 | Kamiyamaguchi et al. | 139/370 A |

FOREIGN PATENT DOCUMENTS

| | | | |
|---|---|---|---|
| 45-10770 | 4/1970 | Japan | 139/370 A |
| 45-11472 | 4/1970 | Japan | 139/370 A |
| 335,315 | 4/1972 | U.S.S.R. | 139/370 A |

*Primary Examiner*—James Kee Chi

*Attorney, Agent, or Firm*—Robert E. Burns; Emmanuel J. Lobato; Bruce L. Adams

[57] ABSTRACT

A circuit stops a loom or indicates a malfunction on receiving either an abnormally long signal or no signal, caused respectively by, thread detector malfunction or faulty loom operation.

6 Claims, 3 Drawing Figures

SYSTEM OF SENSING MALFUNCTION OF A WEAVING LOOM WEFT SENSOR

The present invention relates generally to a method of and a system for sensing a malfunction of a weft detector in a weaving loom and particularly to a method and a system in which, when an inserted weft yarn detecting means produces an electric signal for a period longer than a predetermined period, the electric signal is sensed and weft detector malfunction is detected.

As is well known in the art, a weaving loom is provided with a weft detector which detects an inserted weft yarn reaching the other side of the shed of warp yarns opposite to weft inserting means. The weft detector permits operation of the loom when a weft yarn has reached the other side of the warp shed upon insertion of the weft yarn and stops operation when the weft yarn has been unable to reach the other side.

However, if a weft yarn has been unable to reach the other side of the warp shed upon insertion and the weft detector malfunctions due to waste thread attached to the electrodes or as a result of components damaged or falling off, the loom operates as if the weft yarn has reached the other side of the warp shed, resulting in faultily woven fabric.

It is, therefore, an object of the invention to provide a method and a system in which, when means to detect an inserted weft yarn produces an electric signal for a period longer than predetermined, the electric signal is detected and a malfunction of the weft detector is detected.

This and other objects and advantages of the invention will become more apparent from the following detailed description taken in conjunction with the accompanying drawings in which.

Figure 1:
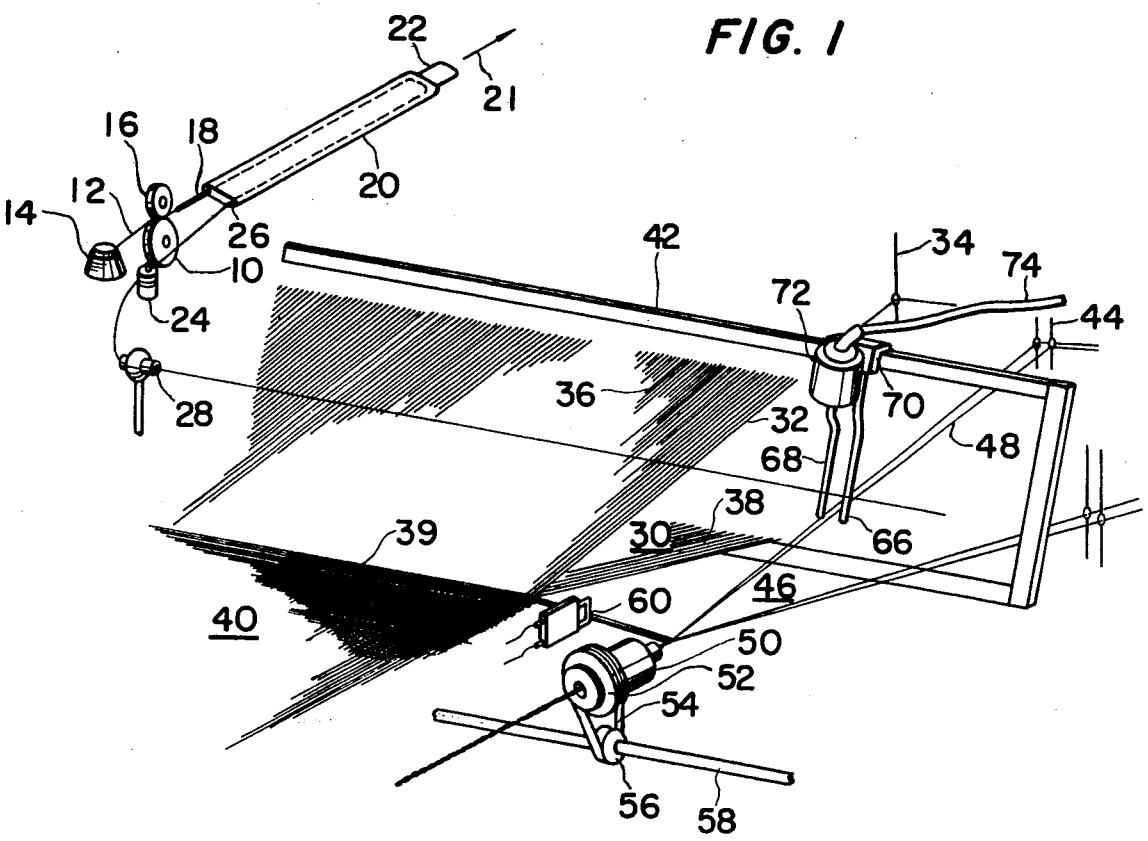
FIG. 1 is a schematic view of one part of a first preferred embodiment of a trouble or malfunction detecting system according to the invention.

Referring to FIG. 1, there is shown a fluid jet shuttleless loom comprising a feed or measuring roller 10 which is driven by drive means (not shown) of the loom and which engages a nip or press roller 16 to continuously draw off a weft yarn 12 from a weft supply package or bobbin 14 at a predetermined speed so that the weft yarn 12 is delivered from the yarn supply package 14 therebetween. The weft yarn 12 leaving the feed and nip rollers 10 and 16 is fed through a yarn inlet 18 into a tubular storage chamber 20 and is temporarily suspended therein in a loop by a stream 21 of air flowing through the storage chamber 20 from an end 22 thereof. Gripping means 24 is provided which serves to temporarily grip the weft yarn 12 delivered from the storage chamber 20 through a yarn outlet 26. The weft yarn 12 released from the gripping means 24 is inserted by a nozzle 28 into the shed 30 formed by the warp yarns 32. Pressurized fluid is supplied to the nozzle 28 to form a jet which, when leaving the nozzle 28, entrains the weft yarn 12 and carries it into the shed 30. First healds 34 are provided to form upper and lower parallel warp sheets 36 and 38 extending in their tensioned states to form the shed 30 therebetween. The weft yarn 12 inserted into the shed 30 is beat-up to the fell 39 of the woven fabric 40 by a reed 42. Second healds 44 are provided to form a shed 46 of warp yarns 48 in synchronism with the action of the first healds 34. Twisting means 50 is provided which serves to twist the warp yarns 48 so that the weft yarn 12, after it has been beat-up, is held between the warp yarns 48. The twisting means 50 is driven by a pulley 52 which is driven by a belt 54 from a pulley 56 mounted on a drive shaft 58 of the loom. Cutting means 60 is provided between the woven fabric 40 and the twisting means 50 for cutting off the weft yarn 12 held by the warp yarns 48.

The weaving loom comprises first and second electrodes 66 and 68 which form a part of a trouble or malfunction detecting system according to the invention and which also serve as weft insertion detecting members. The first electrode 66 is fixedly secured to the reed 42 through a bracket 70 and is grounded by way of the reed 42. The second electrode 68 is fixedly secured to the bracket 70 through an insulating member 72 and is spaced apart from the first electrode 66. The electrodes 66 and 68 form a part of a weft insertion detector (not shown) which detects a weft yarn reaching the side of the shed 30 opposite to the nozzle 28 at each insertion of weft yarn into the shed 30 and which stops operation of the loom when a weft yarn has been unable to complete fully its travel to its destination in shed 30.

Figure 2:
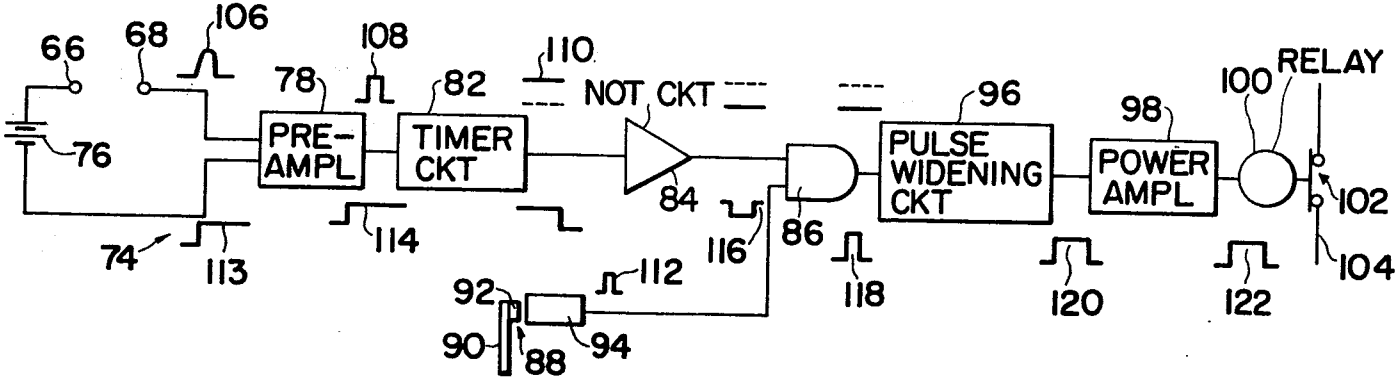
FIG. 2 is a circuit diagram of an electric control circuit forming the other part of the first preferred embodiment.

Referring to FIG. 2, there is shown an electric control circuit which forms the other part of the trouble or malfunction detecting system according to the invention. The electric control circuit generally designated by the reference numeral 74 includes the first and second electrodes 66 and 68 and a d.c. power source such as a battery 76. The electrode 68 is connected to one of two terminals of a pre-amplifier 78. The power source 76 is connected to the other terminal of the pre-amplifier 78. The electrodes 66 and 68 serve respectively as first and second stationary contact members. The weft yarn 12 serves as a movable contact member. The electrodes 66 and 68 and the weft yarn 12 constitute a switch. When the electrodes 66 and 68 come into contact with the wefy yarn 12, an electric signal indicating the presence of the weft yarn 12 is passed to the pre-amplifier 78 through the electrodes 66 and 68. The pre-amplifier 78 serves to amplify the electric signal to produce an output signal having a rectangular wave form and a predetermined power level. The pre-amplifier 78 is connected to the input terminal of a switching or timer circuit 82 which serves to produce an output signal when the output signal of the pre-amplifier 78 is applied thereto for a period of time shorter than a predetermined time period and to cease generation of the output signal when the output signal of the amplifier 78 is applied to the timer circuit 82 for a period of time longer than the predetermined time period. It is to be noted that the predetermined time period is longer than the period of time that the electrodes 66 and 68 are kept in contact with the weft yarn 12, that is, the period of time after the electrodes 66 and 68 have come into contact with the weft yarn 12 and until the beat-up is finished. The timer circuit 82 is connected to the input terminal of a NOT circuit 84 which does not produce an output signal or as will be hereafter described, produces no output signal, when the output signal of the timer circuit 82 is present but which produces an output signal when the output signal of the timer circuit 82 is absent. The NOT circuit 84 is connected to one of two input terminals of an AND gate logic circuit 86. A pulse generator 88 is provided which serves to generate a pulse signal at a predetermined time while the reed 42 is moved from its beat-up position to a position opposite thereto. The predetermined time is timed posterior to the predetermined time period mentioned above. The pulse generator 88 comprises a rotatable arm 90 which is rotated in synchronism with the operation of the loom. A permanent magnet 92 is fixedly secured to a free end of the rotatable arm 90. A coil 94 having an iron core (not shown) therein is stationarily mounted close to the permanent magnet 92. When the rotatable arm 90 is rotated, the pulse signal is produced in the coil 14 every time the permanent magnet 92 faces the iron core. The pulse generator 88 is connected to the other input terminal of the AND gate circuit 86. One terminal of the coil 94 of the pulse generator 88 is grounded. The AND gate circuit 86 produces an output signal only when the output signal of the NOT circuit 84 and the pulse signal of the pulse generator 88 are concurrently present. The AND gate circuit 86 is connected to the input terminal of a pulse stretcher circuit 96 which is connected to the input terminal of a power amplifier 98. A relay 100 is connected to the output terminal of the power amplifier 98. A switch 102 is provided which is actuated by the relay 100 to open a power supply line 104 leading to the loom to stop the operation of the loom when the relay 100 is energized. The pulse widening circuit 96 serves to increase the pulse width of the output signal of the AND gate circuit 86 which width is too narrow to energize the relay 100, for example, 10 milliseconds, and to produce an output signal having a pulse width sufficient to energize the relay 100, for example, 100 milliseconds. In order to stop energization of the relay 100 after it is energized, a memory circuit may be provided which is set by the output signal of the AND gate circuit 86 to produce an output signal and which is reset by an output signal of suitable means (not shown) to cease generation of the output signal. The power amplifier 98 serves to amplify the output signal of the memory circuit 96 to produce an output signal having a power level sufficient to energize the relay 100.

The arrangement thus far described is operated as follows:

When the weft yarn 12 is beat-up by the reed 42, the electrodes 66 and 68 make contact with the weft yarn 12. In this instance, when no foreign matter such as a waste thread is attached to the electrodes 66 and 68, an electric signal 106 is produced for a period of time shorter than the predetermined time period, that is, only while the electrodes 66 and 68 contact the weft yarn 12. The electric signal 106 is applied to and amplified by the pre-amplifier 78 to produce an output signal 108 which is applied to the timer circuit 82. Since the output signal 108 is present only for a period of time shorter than the predetermined time period, the timer circuit 82 produces an output signal 110 which is applied to the NOT circuit 84. As a result, the NOT circuit 84 produces no output signal. The pulse generator 88 produces a pulse signal 112 at a predetermined time while the reed 42 is moved from its beat-up position to a position opposite thereto. The pulse signal 112 is applied to the AND gate circuit 86. Since the output signal of the NOT circuit 84 is absent, the AND gate circuit 86 produces no output signal. Thus, the relay 100 is not energized so that the loom continues to operate.

When a foreign matter such as a waste thread is attached to the electrodes 66 and 68 by some cause, an electric signal 113 is produced for a period of time longer than the predetermined time period, that is, still after the beat-up has taken place. The electric signal 113 is applied to and amplified by the preamplifier 78 to produce an output signal 114 which is applied to the timer circuit 82. Since the output signal 114 is present for a period of time longer than the predetermined time period, the timer circuit 82 ceases generation of an output signal. As a result, the NOT circuit 84 produces an output signal 116 which is applied to the AND gate circuit 86. The pulse generator 88 produces the pulse signal 112 at a predetermined time while the reed 42 is moved from its beat-up position to a position opposite thereto. Since the output signal 116 and the pulse signal 112 are concurrently present, the AND gate circuit 86 produces an output signal 118 which is applied to the pulse stretcher circuit 96 to produce an output signal 120 having an increased pulse width. The output signal 120 is applied to and amplified by the power amplifier 98 to produce an output signal 122 having an increased power level which is applied to the relay 100. The relay 100 is energized by the output signal 122 to actuate the switch 102 to open the power supply line 104 and stop the operation of the loom.

Figure 3:
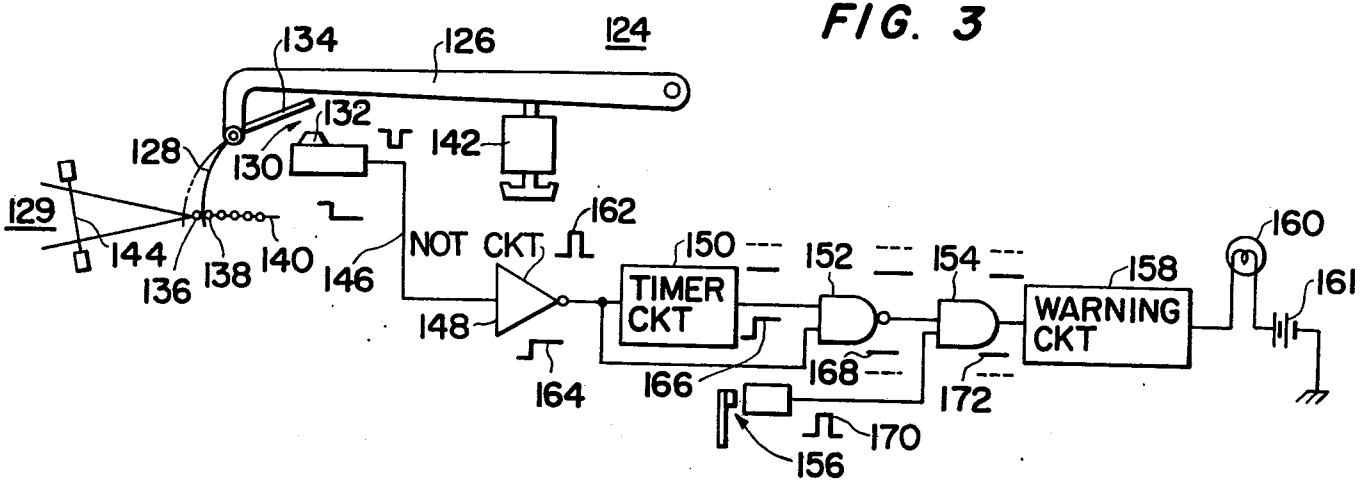
FIG. 3 is a schematic view of a second preferred embodiment of a trouble or malfunction detecting system according to the invention.

FIG. 3 shows a second preferred embodiment of a trouble or malfunction detecting system according to the invention. As shown in FIG. 3, the malfunction detecting system generally designated by the reference numeral 124 comprises an arm 126 which is pivotably mounted at one end. A weft detecting member 128 in the form of an arcuate pin is pivotably mounted on the other end of the arm 126 and is engageable by the weft yarn when the weft yarn is beat-up after is has been inserted into the shed 129 of warp yarns. Switch means 130 is provided which has a stationary contact member 132. A movale contact member 134 is fixedly secured to the weft detecting member 128 and is contactable with the stationary contact member 132. The weft detecting member 128 is normally biased clockwise in the drawing toward the position shown by the phantom line in FIG. 3 by biasing means such as a spring or a permanent magnet (not shown) to keep the movable contact member 134 in contact with the stationary contact member 132 so that the switch means 130 produces an electric signal. The weft detecting member 128 is swung (counterclockwise in the drawing) by a weft yarn 136, when the weft yarn 136 is beat-up, and is sandwiched in between the weft yarn 136 and the weft yarn 138, which was beat-up to the fell of the woven fabric 140 prior to the weft yarn 136, as shown by the solid line FIG. 3 so that the movable contact member 134 is disengaged from the stationary contact member 132 and the switch means 130 ceases generation of the electric signal. A solenoid 142 is provided which serves to swing the arm 126 (clockwise in the drawing) to extract the weft detecting member 128 from between the weft yarns 136 and 138 when energized. The solenoid 142 is energized at a first predetermined time while the reed 144 is moved from its beat-up position to a position opposite thereto.

The malfunction detecting system 124 also comprises an electric control circuit 146 to which the switch means 130 is connected. The switch means 130 is connected to an input terminal of a NOT circuit 148 which produces an output signal when the electric signal of the switch means 130 is absent and which produces no output signal when the electric signal of the switch means 130 is present. The NOT circuit 148 is connected to the input terminal of a switching or timer circuit 150 which produces no output signal when the output signal of the NOT circuit 148 is applied thereto for a period of time shorter than a predetermined time period and which produces an output signal when the output signal of the NOT circuit 148 is applied thereto for a period of time longer than the predetermined time period. It is to be noted that the predetermined time period is longer than the period of time that the weft detecting member 128 is kept in contact with the weft yarn 136 or the period of time after the movable contact member 134 has been disengaged from the stationary contact member 132 and until the solenoid 142 is energized. The NOT circuit 148 is also connected to one of two input terminals of a first AND gate logic circuit 152. The timer circuit 150 is connected to the other input terminal of the first AND gate circuit 152. The AND gate circuit 152 produces an output signal only when the output signals of the NOT and timer circuits 148 and 150 are concurrently present. The first AND gate circuit 152 is connected to one of two input terminals of a second AND gate logic circuit 154. A pulse generator 156 is provided which is similar to the pulse generator 88 of the malfunction detecting system described above with reference to and illustrated in FIGS. 1 and 2. The pulse generator 156 produces a pulse signal at a second predetermined time while the reed 144 is moved from its beat-up position to a position opposite thereto. The second predetermined time is later than the first predetermined time and is posterior to the predetermined time period. The pulse generator 156 is connected to the other input terminal of the second AND gate circuit 154. The second AND gate circuit 154 produces an output signal only when the output signal of the first AND gate circuit 152 and the pulse signal of the pulse generator 156 are concurrently present. The second AND gate circuit 154 is connected to the input terminal of a warning circuit 158. A warning lamp 160 is connected to the output terminal of the warning circuit 158 for producing a warning signal when energized and also to the positive terminal of a d.c. power source such as a battery 161 the negative terminal of which is earthed.

The arrangement of FIG. 3 thus far described is operated as follows:

When the weft yarn 136 is beat-up by the reed 144 with the weft detecting member 128, movable contact member 134 and/or solenoid 142 not subjected to any trouble, the weft detecting member 128 is swung (counterclockwise in the drawing) by the weft yarn 136 and is sandwiched between the weft yarns 136 and 138 as shown by the solid line in FIG. 3. Concurrently, the movable contact member 134 is disengaged from the stationary contact member 132. As a result, the switch means 130 ceases generation of the electric signal. This state is maintained until the solenoid 142 is energized so that the weft detecting member 128 is pulled out from between the weft yarns 136 and 138 and the movable contact member 134 comes into contact with the stationary contact member 132. Since the electric signal of the switch means 130 is absent, the NOT circuit 148 produces an output signal 162 which is applied to the timer circuit 150 and the first AND gate circuit 152. Since the output signal 162 is produced for a period of time shorter than the predetermined time period as mentioned above, the timer circuit 150 produces no output signal. Thus, the warning lamp 160 is not energized to produce a warning signal.

When the movable contact member 134 is kept disengaged from the stationary contact member 132 on account of a trouble of the weft detecting member 128 and/or solenoid 142 or the movable contact member 134 falling off, the switch means 130 continues generation of no electric signal for a period of time longer than the predetermined time period mentioned above. As a result, the NOT circuit 148 produces an output signal 164, which is applied to the timer circuit 150 and the first AND gate circuit 152, for a period of time longer than the predetermined time period. Thus, the timer circuit 150 produces an output signal 166 which is applied to the first AND gate circuit 152. The first AND gate circuit 152 produces an output signal 168, in response to the output signals 164 and 166 of the NOT and timer circuits 148 and 150, which is applied to the second AND gate circuit 154. The pulse generator 156 produces a pulse signal 170 at a predetermined time while the reed 144 is moved from its beat-up position to a position opposite thereto. The second AND gate circuit 154 produces an output signal 172, in response to the output signal 168 of the first AND gate circuit 152 and the pulse signal 170 of the pulse generator 156, which is applied to the warning circuit 158. Thus, the warning lamp 160 is energized to produce a warning signal.

It will be appreciated that trouble or malfunction in a weft detector in a weaving loom is detected to stop the operation of the loom or produce a warning signal, when means to detect a weft yarn inserted into the shed of warp yarns to produce an electric signal produces it for a period of time longer than a predetermined time period.

A center weft fork or a side weft fork may be employed as weft detecting means in lieu of the electrodes 66 and 68 and a combination of the arm 126, weft detecting pin 128, switch 130 and solenoid 142.

Weft detecting means may be disposed on the side of the shed 30 facing the nozzle 28 or within the shed in lieu of the side of the shed 30 opposite to the nozzle 28.

Although the invention has been described as being applied to a shuttleless loom, the invention can also be applied to a gripper shuttle loom.

What is claimed is:

1. A system for use on a loom for sensing malfunction in a weft sensor of a weaving loom comprising, means to sense a weft yarn for producing an electrical signal in dependence upon said weft yarn having reached a predetermined position upon insertion of said weft yarn in a shed of a weaving loom comprising an electric circuit including therein two electrodes spaced apart from each other, said electric circuit being closed to produce said electric signal when said weft yarn touches both electrodes, a timer circuit connected to said electric circuit to produce an electrical signal representative of malfunction in the weft sensor when said means produces said electric signal for a period of time longer than a predetermined period of time including beat-up time, a NOT circuit connected to receive an output of said timer circuit, means in said timer circuit for producing an output signal when said electric signal is applied thereto from said electric circuit for a period of time shorter than said predetermined time period and ceasing generation of said output signal when said electric signal is applied thereto from said electric circuit for a period of time longer than said predetermined time period, and said NOT circuit comprising means for producing an output signal for stopping the operation of said loom when said output signal of said timer circuit is absent.

2. A system for sensing malfunction in a weft sensor of a weaving loom having a reed comprising, means to sense a weft yarn having reached a predetermined position upon insertion of said weft yarn in a shed of weaving loom for producing an electric signal, in dependence upon the weft yarn having reached said predetermined position, said means comprising an electric circuit including therein two electrodes spaced apart from each other, said electric circuit being closed to produce said electric signal when said weft yarn touches both electrodes, a timer circuit to produce an electric signal representative of malfunction in said weft sensor when said means produces said electric signal for a period of time longer than a predetermined period of time including beat-up time, means for connecting said timer circuit to said electric circuit, a NOT circuit connected to receive an output of said timer circuit, means in said timer circuit for producing an output signal when said electric signal is applied thereto from said electric circuit for a period of time shorter than said predetermined time period and ceasing generation of said output signal when said electric signal is applied thereto from said electric circuit for a period of time longer than said predetermined time period, said NOT circuit comprising means for producing an output signal for stopping the operation of said loom when said output signal of said timer circuit is absent, a pulse generator for producing a pulse signal at a predetermined time while the reed is moved from its beat-up position to a position opposite thereto, said predetermined timing being posterior to said predetermined time period, and an AND gate logic circuit having two input terminals connected respectively to receive an output of said NOT circuit and said pulse generator, and said AND gate logic circuit having means for producing an output signal for stopping the operation of said loom when said NOT circuit and said pulse generator concurrently produce said output signal and said pulse signal, respectively.

3. A system as claimed in claim 2, further comprising a pulse widening circuit connected to receive an output terminal of said AND gate circuit and having means for producing an output signal having a pulse width wider than that of said output signal of said AND gate circuit, a power amplifier connected to receive an output of said pulse widening circuit and amplifying said output signal produced thereby to convert into an amplified output signal, a relay connected to the output terminal of said power amplifier, and a switch opened by said relay to cut power supply to the loom when said relay is energized by said output signal of said power amplifier.

4. A system for sensing malfunction in a weft sensor of a weaving loom having a reed comprising, means to sense a weft yarn having reached a predetermined position upon insertion of said weft yarn in the shed of a weaving loom for producing an electric signal in dependence upon said weft yarn reaching said position, said means comprising switch means having a stationary contact member, a movable contact member having a sensing member swung in operation by said weft yarn and sandwiched in between said weft yarn and a woven fabric when said weft yarn is beat-up, said movable contact member being normally in contact with said stationary contact member to produce an output signal and disengaged therefrom to cease generation of said output signal when said weft sensing member is swung by said weft yarn, an arm operable to extract said weft sensing member from between said weft yarn and said woven fabric at a first predetermined time while the reed is moved from its beat-up position to a position opposite thereto, a timer circuit to produce an electric signal representative of malfunction in said weft sensor when said means produces said electric signal for a period of time longer than a predetermined period of time including beat-up time, said predetermined time period including said first predetermined time, and a NOT circuit connected to said switch means and to the input terminal of said timer circuit, and said timer circuit ceasing generation of said electric signal when said NOT circuit produces an output signal for a period of time shorter than said predetermined time period and producing said electric signal when said NOT circuit produces an output signal for a period of time longer than said predetermined time period.

5. A system for sensing malfunction in a weft sensor of a weaving loom having a reed comprising, means to sense a weft yarn having reached a predetermined position upon insertion of said weft yarn in a shed of a loom having a reed and for producing an electric signal, said means comprising switch means having a stationary contact member, a movable contact member having a weft sensing member swung in operation by said weft yarn and sandwiched in between said weft yarn and a woven fabric when said weft yarn is beat-up, said movable contact member being normally in contact with said stationary contact member to produce an output signal and being disengaged therefrom to cease generation of said output signal when said weft sensing member is swung by said weft yarn, an arm operable to extract said weft sensing member from between said weft yarn and said woven fabric at a first predetermined time while the reed is moved from its beat-up position to a position opposite thereto, a timer circuit to produce an electric signal representative of malfunction in said weft sensor when said means produces said electric signal for a period of time longer than a predetermined period of time including beat-up time, said predetermined time period including said first predetermined time, a NOR circuit connected to said switch means and to the input terminal of said timer circuit, said timer circuit ceasing generation of said electric signal when said NOT circuit produces an output signal for a period of time shorter than said predetermined time period and producing said electric signal when said NOT circuit produces an output signal for a period of time longer than said predetermined time period, a first AND gate circuit having two input terminals connected respectively to the output terminals of said NOT circuit and said timer circuit, a pulse generator for producing a pulse signal at a second predetermined time while the reed is moved from its beat-up position to a position opposite thereto, said second predetermined time being later than said first predetermined time and being later than said predetermined time period, and a second AND gate circuit having two input terminals connected respectively to receive outputs of said first AND gate circuit and said pulse generator.

6. A system as claimed in claim 5, further comprising warning means connected to receive an output of said second AND gate circuit for producing a warning signal when said movable contact member is disengaged from said stationary contact member for a period of time longer than said predetermined time period.

* * * * *